United States Patent [19]

Mier

[11] 3,996,950

[45] Dec. 14, 1976

[54] OBSTACLE DETECTION DEVICE FOR USE BY THE BLIND

[76] Inventor: Randall Mier, 447 Norway Ave., Trenton, N.J. 08629

[22] Filed: Apr. 30, 1975

[21] Appl. No.: 573,187

[52] U.S. Cl. ..... 135/66; 135/85; 135/DIG. 11; 200/61.44; 200/61.85; 340/258 R; 340/407

[51] Int. Cl.[2] ..... A45B 3/04; A61H 3/06

[58] Field of Search ..... 135/45 R, 45 A, 47, 135/63; 180/19 H, 91, 94, 96; 293/2, 4; 340/258 R, 407; 128/394; 200/52 R, 61.44, 61.85

[56] References Cited

UNITED STATES PATENTS

| | | | |
|---|---|---|---|
| 1,177,582 | 3/1916 | Murphy | 135/47 |
| 2,600,708 | 6/1952 | Ulrich | 16/110 R X |
| 3,158,162 | 11/1964 | Reel | 135/47 |
| 3,158,851 | 11/1964 | Ruthven | 135/47 X |
| 3,251,371 | 5/1966 | Croker | 135/47 |

*Primary Examiner*—Werner H. Schroeder
*Assistant Examiner*—Conrad L. Berman
*Attorney, Agent, or Firm*—Sperry and Zoda

[57] ABSTRACT

A rollable device, designed to be pushed by a blind person, has a plurality of sensors so spaced and so located upon a wheeled mount as to detect the presence of an object, step, or depression in the path of the user, and in so doing actuate electrical means designed to instantaneously inform the user of the presence of the potentially dangerous condition.

The electrically actuated means includes vibratory devices in the handle of the device, so located as to acquaint a blind person with the locaton and nature of the dangerous condition in his or her path. Means is also incorporated in the device, in the form of a buzzer or other electrically actuated audible device, signifying the presence of objects such as automobile bumpers which are elevated above the ground surface and would therefore otherwise go undetected.

Incorporated in the device, also, is a means actuable by the user for sounding a horn or the like for the purpose of seeking help or for warning others of his approach.

The invention incorporates side and front bumpers, an antenna-like member, and a wheel suspension that drops bodily, as sensors having the capability of detecting a wide variety of dangerous conditions that may be encountered by a blind person.

5 Claims, 9 Drawing Figures

OBSTACLE DETECTION DEVICE FOR USE BY THE BLIND

BACKGROUND OF THE INVENTION

1. Field of Invention

The invention relates, generally speaking, to aids for the blind and in a more particular sense to walking aids in which the detection of obstacles, depressions, steps, and the like is effected mechanically, with a feeler or sensing device being caused to move from a normal position in such fashion as to actuate electrical means for alerting the user.

2. Description of the Prior Art

The prior art as known to me includes the following U.S. Pat. Nos.

| | |
|---|---|
| G. J. Vaughan | 1,527,239 |
| F. Murphy | 1,177,582 |
| O. E. Edstrom | 2,379,426 |
| G. B. Dusinberre | 2,445,942 |
| R. J. Kinney | 2,683,461 |
| R. C. Reel | 3,158,162 |
| C. C. Hagood, Sr. | 3,223,099 |
| C. O. Croker | 3,251,371 |

Prior art such as represented by the above listed patents has failed to offer a complete solution to the problems encountered by the blind, in that those devices that are intended to offer maximum assistance have in general been excessively complex and hence expensive. Alternatively, devices as heretofore conceived have failed to include means for sensing all the objects or surface irregularities that a blind person would be likely to encounter while walking.

Thus, wheeled devices have been provided, as will be noted from certain of the above listed patents, but have failed to provide a particular combination of side sensors, and sensors of elevated objects, such as the bumpers of parked vehicles, etc. Further, the prior art, where it does show electromechanical means of the character described, fails to show a particular combination of power source, switches, and alarm devices in which mechanical actuate electrical circuitry that extends through the rollable platform, tubular push-bar, and handle of the aid while still permitting normal one-hand operation of the device by the user.

SUMMARY OF THE INVENTION

Summarized briefly, the invention comprises a wheeled platform, having front and side bumpers or sensing elements, deflectable on contact with an obstacle located in the user's path, to actuate electrical switches each of which is in circuit with a particular alarm device. In accordance with the invention, a plurality of the alarm devices are mounted in the handle in such fashion as to permit the user to become immediately aware of the location of the sensed object, in that a depression or step directly ahead actuates a vibratory element sensed by the middle of the user's hand, an object of the left side of the user's path actuates a vibratory member sensed by the left side of the user's hand, etc. Other audible devices, each having a characteristic sound, are provided upon the platform itself, and are actuated when, for example, an elevated obstacle such as an automobile bumper is sensed, or a lower object directly in the path of the user is detected by the front bumper.

In the event the user finds it necessary to summon aid or provide a warning of his approach, he is enabled to actuate a horn or the like by depression of a push button conveniently located upon the handle.

DESCRIPTION OF THE PREFERRED EMBODIMENT

Figure 2:
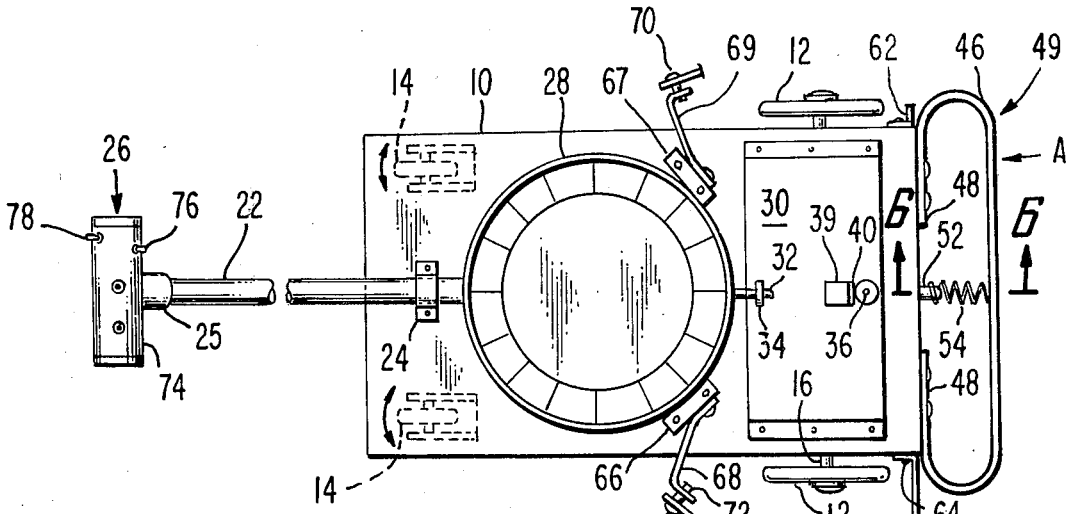
FIG. 2 is a top plan view, in which portions have been broken away.

The device comprising the present invention includes a flat, rollable platform or base 10, the exterior configuration of which can be varied as desired, the rectangular shape seen in FIG. 2 being merely one example of various platform configurations that can be used to advantage. Platform 10 is provided with a pair of front wheels 12 and swiveled rear wheels or castors 14.

Figure 5:
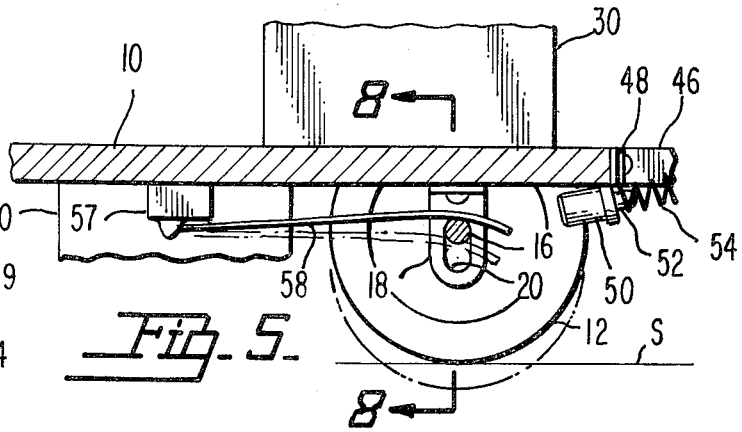
FIG. 5 is an enlarged, fragmentary, longitudinal sectional view substantially on line 5—5 of FIG. 3, the dotted lines indicating the position of the depression-sensing means.
Figure 7:
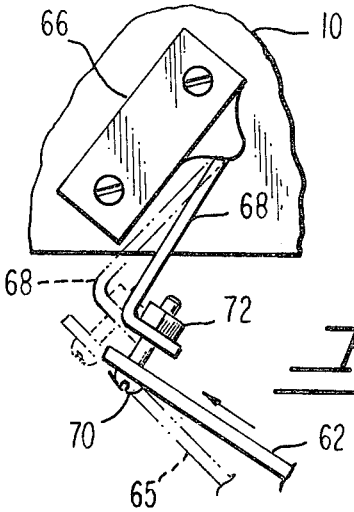
FIG. 7 is an enlarged fragmentary plan view illustrating the sensing means constituted by one of the side bumpers, the dotted lines indicating the position of a switch arm when actuated.

Front wheels 12 are mounted upon an axle 16, the opposite end portions of which are freely rotatable in axle support brackets 18 of inverted L-shape, fixedly secured to the underside of platform 10 at opposite sides thereof (see FIG. 8) and formed with vertically extending bearing slots 20 through which the end portions of the axle extend. Slots 20 have curved upper and lower ends, in correspondence with the circular cross-section of the axle. Normally, when the device is being moved along a flat surface S, the axle will be in the full line position shown. When, however, the front wheels encounter a drop or depression in surface S, (for example, a descending step), axle 16 drops to the dotted line position shown in FIGS. 5 and 8, in which position the axle now bears in the lower ends of the slots.

Figure 1:
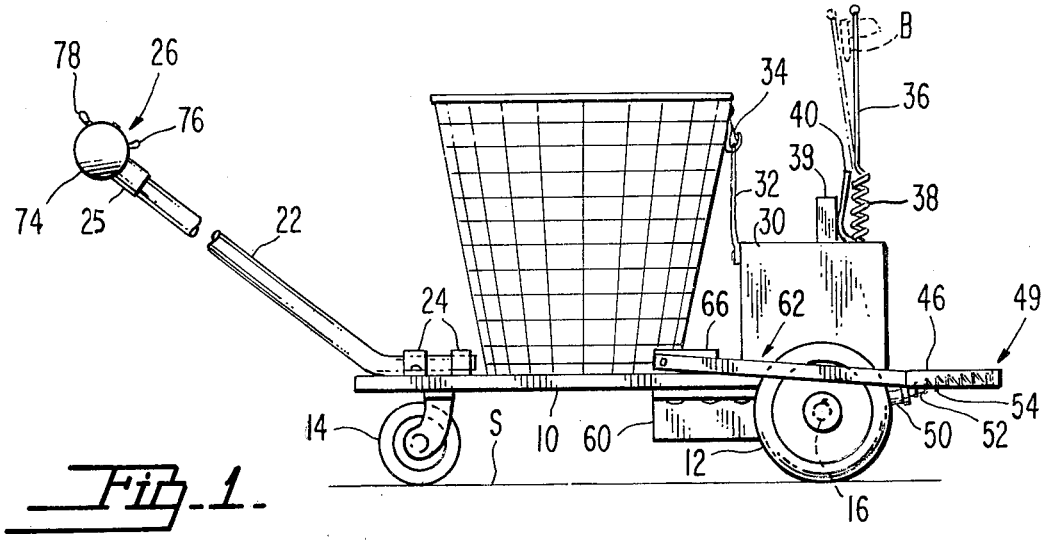
FIG. 1 is a side elevational view of a rollable aid for the blind, constructed in accordance with the present invention, a portion of the push bar being broken away.
Figure 4:
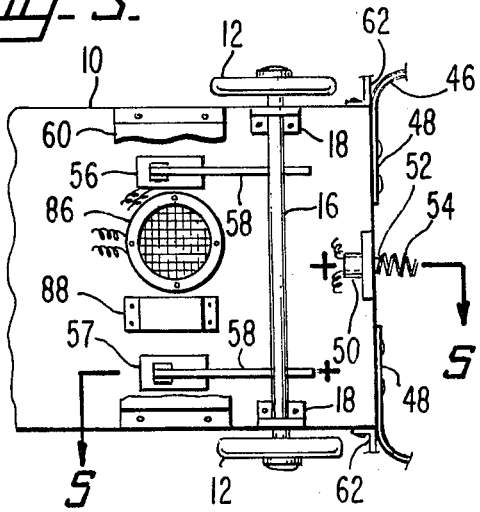
FIG. 4 is an enlarged top plan view of the handle portion as it appears when grasped in normal fashion by a user.

Referring to FIGS. 1, 2, and 4, the device includes an elongated, centrally disposed push-bar 22, which extends rearwardly and upwardly from the rear edge of the platform 10, and has a horizontally extending front end portion overlying the platform and secured fixedly to the platform, as by means of clamps 24 or equivalent fastening devices.

The push-bar 22 is of tubular construction and at its upper, rear end is received within and fixedly secured to a sleeve 25, rigid with the mid-portion of a transversely disposed handle generally designated 26. The handle and the push-bar are so designed as to accommodate various electrical components and wiring, in a novel arrangement to be described in full detail hereinafter.

It may be desired that the user camouflage, so to speak, the basic function of the device, by the provision of a receptacle such as a basket 28 supported upon the platform. In this way, the device is given the appearance of a shopping cart of basically conventional appearance, thus attracting less attention from passersby than might otherwise be the case. In any event, the basket 28 has, of course, a utilitarian purpose, in that it may indeed adapt the device for a true dual function, namely, the function of an obstacle and depression detection aid for a blind person, and the second function of providing a shopping cart for the user.

Figure 9:
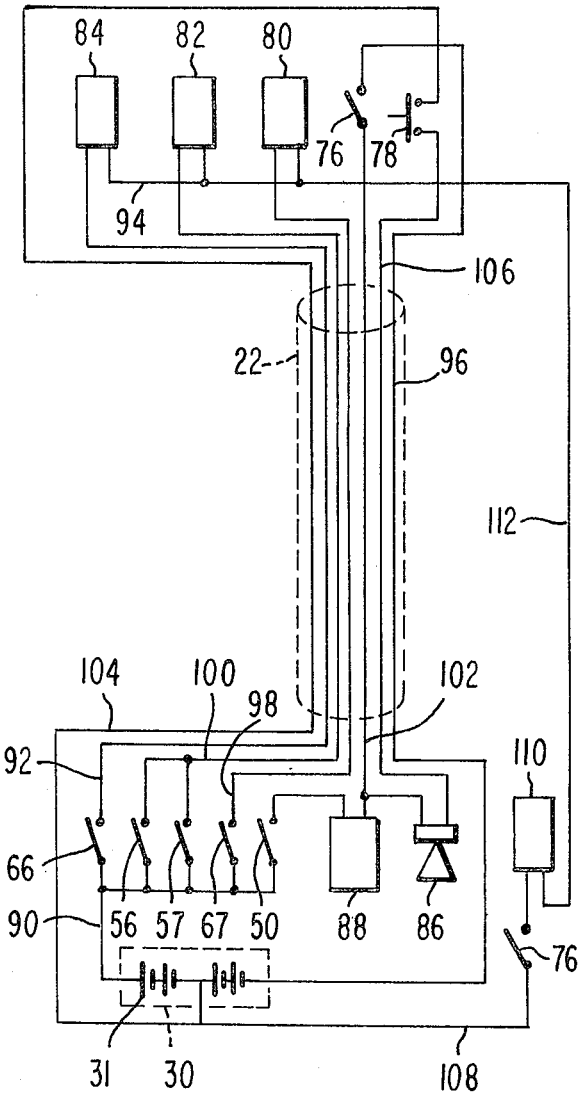
FIG. 9 is a wiring diagram of the electrical components of the invention.

Forwardly of the basket 28, there is mounted upon the platform a housing 30, within which there may disposed a battery 31 (FIG. 9), along with various other devices such as wiring extending from the battery to the several electrical components of the aid, etc. No attempt has been made herein to illustrate the particular arrangement of the components within housing 30, since obviously, this can be varied according to the needs or desires of the particular manufacturer.

Preferably, however, the basket 28 is held in place through the provision of a flexible connecting element 32, secured at one end to housing 30 and extending upwardly therefrom, the upper end of the element 32 being attached to a clasp 34 carried by basket 28. In this way, the basket 28 is detachably connected to the rollable assembly, in such fashion that any unauthorized attempt to remove the basket would be quickly detected by the blind person, while at the same time permitting the user to remove the basket whenever he or she should so desire.

Mounted upon the housing is an upwardly extending, rod-like sensing device 36, the lower end of which is resiliently supported through the provision of a coil spring 38, attached to housing 30. The sensing device 36, 38, indeed can comprise a typical automobile radio antenna of well known design, although as will be understood it is provided not to serve as an antenna but rather as a feeler or sensor designed to make contact with elevated objects such as an automobile bumper B of a parked automobile. Of course, other rod-like, resiliently mounted devices can be used, as for example, so-called "curb feelers" commonly used on automobiles. If, however, a curb feeler is utilized, it should of course be of sufficient length as to assure that it will contact an elevated obstacle of a type that would be normally encountered by one while walking.

Sensing device 36, when it contacts the elevated obstacle, is deflected rearwardly to the dotted line position shown in FIG. 1, and in these circumstances, makes contact with and deflects a switch arm 40, mounted upon a switch 39, which can be secured in an upstanding position upon the top wall of housing 30 (for example, by insertion in a conventional battery mount or clasp). Thus, when the sensing element 36 is deflected, it operates arm 40 to a switch-closing position, to close a circuit between the battery and an alarm device in a manner to be described in full detail hereinafter.

The aid further includes a bumper-like sensing element extending across the front of and projecting forwardly from the platform. This device is seen to best advantage in FIGS. 1, 2, and 5, and in a preferred embodiment comprises an elongated, flat spring member 44, which over its full length is protectively sheathed in soft rubber as at 46. In the illustrated example (see FIG. 2) the respective end portions 48 of the bumper-like sensing element 49, constituted by the member 44 and sheath 46, are bent inwardly and fixedly secured to the platform, to form element 49 as a closed loop.

A forwardly projecting, momentary-contact, normally open switch 50 is carried by a bracket secured to the front edge of the platform and is slightly inclined from the horizontal, said switch 50 including a depressible plunger 52.

A compression spring 54 is interposed between the element 49 and switch 50, said spring having its convolutions, at the rear end of the spring, closed tightly about plunger 52. Whenever element 49 contacts an object, the element will deflect, to in turn urge rearwardly the spring 54, whereby to cause plunger 52 to be depressed and close the switch.

Transversely spaced bottom switches 56,57 mounted upon the underside of the platform, include actuating arms 58 the front end portions of which are in overlying relation to axle 16. Normally, arms 58 will be held upwardly by the axle. When wheel 12 adjacent switch 56 drops, arm 58 of switch 56 will move to the dotted line position shown in FIG. 5, closing switch 56.

Similarly, should the wheel 12 adjacent switch 57 drop, the switch arm 58 of switch 57 will drop closing switch 57.

If both wheels drop simultaneously, both arms 58 will drop, closing both bottom switches.

Protectively covering the bottom switches in a cover plate 60, having flanged ends secured to the underside of the platform The invention also includes side sensing members 62. Referring to FIG. 2, these are of identical but opposite formation, each including a front portion 63 secured at 64 to the adjacent front corner portion of the platform, and extending laterally outwardly therefrom in line with the front edge of the platform. At their outer ends, the front portions 63 merge into rearwardly, inwardly extending rear portions 65 terminating at their distal ends in closely spaced relation to the respective, adjacent side edges of the platform 10.

Mounted upon the platform, adjacent the side edges thereof, are right and left hand, normally open, momentary-contact side switches 66, 67, (FIG. 2) having arms 68, 69 respectively projecting laterally outwardly therefrom beyond the side or longitudinal edges of the platform 10. At their outer ends, the switch arms have forwardly projecting extensions, and as seen from FIG. 6, said extensions are connected loosely to the distal ends of the side sensing elements 62, through the provision of screws 70, that engage loosely in smooth-walled openings formed in the side sensing elements and in the switch arms respectively. Nuts 72 on screws 70 maintain the connection and permit such adjustments as may be necessary to provide a proper connection that will normally maintain the switches in open position, but will, at the same time, assure that each switch arm will be deflected to the dotted line position shown in FIG. 6, if the side sensing element associated therewith should contact an obstacle at, for example, point C shown in FIG. 2.

Referring particularly to FIG. 4, handle 26 comprises a transversely disposed, cyclindrical, hollow housing 74 the ends of which may be closed by removal end caps 75 to permit access to the components housed therein. Adjacent the left hand extremity of housing 74, there is mounted within the housing an on/off master control switch 76. Adjacent switch 76, and located where it can be conveniently depressed by the user, is a plunger-type, normally open, alarm switch 78.

In accordance with the invention, spaced longitudinally of the housing 74 are vibratory devices 80, 82, 84. These are, per se, conventional, and in each instance, may include vibratory elements, buttons, or clappers projecting through openings of the housing so as to be in contact with the hand of the user when the hand is grasping the handle in the normal fashion shown in FIG. 4. As will be noted, vibratory device 80 is to the left of center, device 82 is substantially centrally located between the ends of the housing 74, and device 84 is to the right of center.

Figure 3:
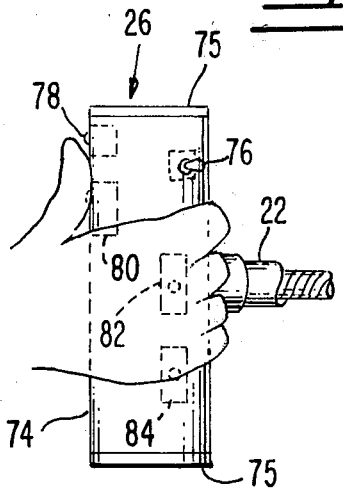
FIG. 3 is a fragmentary bottom plan view of the device, illustrating the means for sensing depressions or steps.

Referring now to FIG. 3, in the illustrated example, I have mounted an electrically actuated horn or other audible alarm device 86 on the underside of platform 10, where it will be protectively enclosed by the cover plate 60. Adjacent the horn 86 there is provided a buzzer 88. These devices, it should be noted at this point, could be located equally advantageously and possibly even more so, within the housing 30. The illustrated arrangement is merely representative of one type of assembly that can be utilized.

Figure 8:
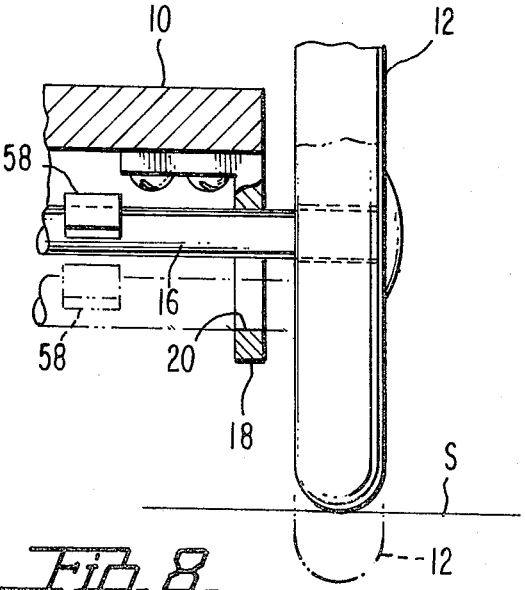
FIG. 8 is an enlarged, vertical sectional view substantially on line 8—8 of FIG. 5, the parts being illustrated in full lines as they appear normally and in dotted lines as they appear when a depression is encountered.

Reference should now be had to FIG. 8, illustrating the electrical circuitry embodied in the device. Within housing 30 there is provided a battery 31, from the positive terminal of which extends lead 90 connected to one terminal of switches 66, 56, 57, 67, and 50.

Extending from the other terminal of switch 66 is lead 92, extending to one terminal of the right hand vibrator 84, from the other terminal of which extends lead 94 connected to one terminal of lead 76, having its other terminal connected to lead 96 offering a return to the power source 31. Switch 76 is open when the aid is not in use. The user would normally close the switch 76 on each occasion of use of the device, so as to permit circuits to be closed through the various electrical components, in the normal discharge of the functions of the aid.

Similarly, switches 56, 57 are respectively connected to lead 90 and to a lead 100, in such fashion that if either or both of the switches 56, 57 should be closed, a circuit will be closed through lead 90, lead 100, the center vibrator 82, lead 94, switch 76, and back to the power source through the return lead 96. In similar fashion. the left hand side switch 67, when closed, will close a circuit through lead 90 from the power source, lead 98, the left hand vibrator 80, and back to the source of power through switch 76 and lead 96.

Upon each closure of switch 50, a circuit will be closed through lead 90, the switch 50, the audible alarm device 88, lead 102, and back to the source of power through the master control switch 76 and lead 96.

Should the user depress momentary-contact switch 78, a circuit will be closed through a lead 104 connected to positive terminal of battery 31, switch 78, lead 106, horn 86, lead 102, switch 76 and return to the source of power through lead 96.

Also connected to the positive terminal of the battery 31, is a lead 108, connecting the source of power to series-connected switch 39 and audible alarm device 110, which could be conveniently mounted within housing 30. Providing a connection to the other terminal of the source of power is lead 112 connected between device 110 and switch 76.

OPERATION

In use, the blind person would first close switch 76 to put all circuits in a standby condition.

While pushing the device forward, the user may encounter an elevated object such as the automobile bumper B. In this event, feeler or sensing element 36 deflects, closing switch 39, to energize horn or buzzer 110. At this point, it may be noted that the sounds of the audible devices 88, 86, 110 are all distinctly different one from another so that the user immediately recognizes that there is in his path an elevated obstacle.

As soon as the obstacle is cleared, normally open switch 39, which is of the momentary contact variety, once again opens, deactivating the audible device 110.

Assuming that a lower object is encountered, directly in front of the device, sensing element 49 is deflected, against its inherent spring tension, depressing plunger 52 of switch 50, thus energizing buzzer 88.

Figure 6:
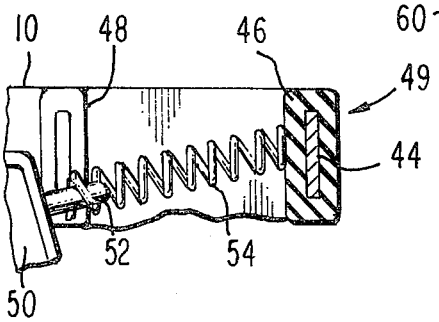
FIG. 6 is a still further enlarged, detail sectional view substantially on line 6—6 of FIG. 2, illustrating the sensing means constituted by the front bumper and an associated switch device.

If an object is encountered which is to be right of the user but still constitutes a potential danger, the right hand side sensing element 62 is deflected against its inherent spring tension to the dotted line position shown in FIG. 6, closing switch 66 to thereby energize the right hand vibrator 84. This is felt by the right side of the user's palm as shown in FIG. 4, so that he immediately becomes aware that he must be careful to avoid an object located toward the right hand side of his path of forward movement. Similarly, should be object be encountered that is at the left of said path, switch 67 is closed by deflection of the left hand side sensor, to energize the left hand vibrator 80, the vibratory element of which is in contact with the thumb or the left hand side of the user's palm.

One of the most serious problems encountered by a blind person, of course, is found in the existence of a step downward or depression directly in his path. The front wheels 12 in this event provide the means for informing the user of the problem. If, for example, there is a step down, both wheels 12 will drop off surface S to the lower position shown in dotted lines in FIGS. 5 and 8. As a result, upon dropping of axle 16, switch arms 58, which are normally held in upper, switch-opening positions by the axle, drop to the dotted line positions thereof shown in FIGS. 5 and 8, thus actuating the center vibrator 82 the vibratory element of which is in contact with the user's palm.

The same operation occurs if either wheel drops. Assume, for example, that there is a hole in the surface S, located in the path of the left hand wheel 12. Although the right hand wheel remains in an upper, normal position, the left hand wheel will drop, closing the left hand switch 57, to actuate vibrator 82. A single vibrator, it has been found, is sufficient to warn the user of steps or depressions, even though a depression may be located to right or left of center in the manner described immediately above.

The same function, of course, will be discharged by the right hand wheel 12 and thus close the right hand switch 56.

In some instances, the user may find it necessary to seek aid. In this event, he can manually close switch 78, to sound horn 86 and thus attract the attention of passersby. Or, he may use the horn 86 to warn others of his approach.

It will be apparent that the relative arrangement of the various sensing elements is such as to provide continuous coverage, fully from the left hand limit of the aid defined by the outermost portion of the left hand side sensor 62, to the corresponding right hand limit defined by the laterally outermost part of the right hand side sensor 62. Any object not contacted by the side sensors will be contacted by the center sensor 49, which extends the full distance between the side sensors and indeed overlaps the side sensing elements slightly. If the object is elevated, so as to escape detection by the side and central sensing elements, it will be detected by the upwardly projecting element 36. And, any depression that is centrally located or to right or left of center, is sensed by the wheels 12. A completely efficient aid, that provides blanket coverage for elevated objects, depressions, and low objects over a wide area taken transversely of the path of movement of the blind person is thus afforded.

The abstract of this application is not intended to constitute a comprehensive discussion of all the principles, possible modes or application of the invention disclosed in this document and should not be used to interpret the scope of the claims which appear herinafter.

I claim:

1. An aid to be used by a visually impaired person for detecting hazards in the path of said person, comprising: a rollable assembly including a base in the form of a flat, horizontal platform having front and rear wheels, said assembly further including an elongated handle means secured to the rear end of the platform and extending rearwardly upwardly therefrom, said handle means being adapted to be grasped by a user to propel the rollable assembly along said path; sensing means carried by said assembly adapted to detect hazards in the path of a visually impaired person, said sensing means being movable from a normal position to an operating position upon detection of a hazard in said path; and electrical alarm means for said rollable assembly actuated by movement of the sensing means to an operating position for informing the visually impaired person of the sensed hazard, the sensing means including a plurality of bumpers and switch means associated therewith, said bumpers being respectively deflectable by hazards encountered thereby and being adapted when deflected to actuate the switch means, the switch means being in circuit with said electrical alarm means, said platform having a leading edge disposed normally to the length of the handle means and extending laterally of the handle means at both sides thereof, the platform having side edges generally parallel to the length of the handle means, said bumpers including a front bumper centrally disposed upon the rollable assembly in front of and generally parallel to the leading edge thereof in position extending transversely of the assembly laterally beyond said side edges of the platform, said bumpers further including side bumpers projecting laterally outwardly from the respective side edges of the platform, the front and side bumpers being generally coplanar with the platform and being disposed in overlapping relation at the respective, opposite sides of the platform.

2. An aid for visually impaired persons as in claim 1, wherein the front bumper is in the form of a resilient, closed loop extending transversely of the rollable assembly fully across and beyond the opposite side edges of the platform into said overlapping relationship with the respective side bumpers, said switch means including a switch disposed between the loop and the leading edge of the platform, said switch including an actuating element protectively enclosed within an area bounded by the leading edge of the platform and said closed loop, said actuating element extending into close proximity to the loop intermediate the opposite side edges of the platform whereby, when the loop encounters an obstacle at any location along the length thereof said actuating element will be operated responsive to deflection of the loop by the obstacle, thus to close the switch for actuation of a component of the alarm means associated therewith.

3. An aid as in claim 1, wherein the side bumpers are identical but opposite, elongated spring elements each of which is anchored at one end to the rollable assembly and includes a distal end spaced outwardly from an adjacent side edge of said platform, each of said distal ends being shiftable in response to deflection of the spring element constituting the side bumper when a hazard is encountered thereby, said switch means including a pair of switches, one for each of the said bumpers, each switch of the pair having an arm loosely connected to and operable by the associated bumper, each arm and the bumper connected thereto defining a closed loop connected at its ends to and projecting laterally outwardly from an associated side edge of the platform, each of said loops being disposed in the general plane of the platform, said switch arm when operated being adapted to close its associated switch, the alarm means including separate alarm devices, one for each of said switches.

4. An aid for a visually impaired person, as in claim 1, wherein said sensing means includes a wheel axle carrying said front wheels and mounted on said rollable assembly, the axle underlying the platform in spaced relation thereto, said sensing means further including vertically slotted bearing brackets for the axle secured to and extending downwardly from the respective side edges of the platform, the ends of the axle being extended through the slots of the respective brackets and independently gravitating to a lower position in the bearing brackets upon encountering descending steps and the like in the path of the user, each end of the axle being free to move upwardly and downwardly within its associated slot independently of the other end thereof, the switch means including a switch having an arm normally retained in an upward position by the axle but dropping to a lower position responsive to gravitation of the axle within the vertically slotted bearing brackets, said arm when moving to a lower position actuating the switch, to close a circuit to the alarm means and thereby provide intelligence to the user as to the existence of the descending step in his path.

5. An aid for a visually impaired person as in claim 1, wherein the sensing means includes a wheel axle carrying said front wheels and mounted on said rollable assembly, said axle underlying the platform in spaced relation thereto, said sensing means further including vertically slotted bearing brackets for the axle secured to and extending downwardly from the respective side edges of the platform, the ends of the axle being extended through the slots of the respective bearing brackets and gravitating to a lower position in the bearing brackets independently of each other upon encountering descending steps and the like in the path of the user, each end of the axle being free to move upwardly and downwardly within its associated slot independently of the other end thereof, said switch means including a pair of switches mounted on the underside of the platform adjacent the respective ends of the axle and the bearing brackets associated with said ends of the axle, each switch including a switch arm overlying and in contact with the end of the axle associated therewith, each of said switch arms being biased upwardly by its associated end of the axle to an upper, switch-opening position when said associated axle end extends through the upper end of the slot of the bracket adjacent thereto, each switch arm being free to move to a lower, switch-closing position when its associated axle end gravitates to the lower end of said adjacent bracket.

* * * * *